United States Patent [19]

Rosado

[11] Patent Number: 4,691,523

[45] Date of Patent: Sep. 8, 1987

[54] THERMODYNAMIC PROCESS FOR A PRACTICAL APPROACH TO THE CARNOT CYCLE

[76] Inventor: Serafin M. Rosado, Marques de Lozoya 15, Madrid, Spain

[21] Appl. No.: 620,364

[22] Filed: Jun. 13, 1984

[30] Foreign Application Priority Data

Jun. 13, 1983 [ES] Spain ..... 523210

[51] Int. Cl.[4] ..... F01K 25/06

[52] U.S. Cl. ..... 60/649; 60/671

[58] Field of Search ..... 60/651, 671, 649

[56] References Cited

U.S. PATENT DOCUMENTS 3,006,146 10/1961 Jackson ..... 60/649 X 4,439,988 4/1984 Minardi et al. ..... 60/649

*Primary Examiner*—Allen M. Ostrager

*Attorney, Agent, or Firm*—Ostrolenk, Faber, Gerb & Soffen

[57] ABSTRACT

A thermodynamic process having an efficiency close to that of the ideal Carnot cycle. The process fluid is a combination of Dowtherm A and water and undergoes constant pressure transformations to absorb heat from a heat source and to transfer heat to a heat sink, and also undergoes constant temperature expansion and constant temperature pressurization. The process provides a practical application, in single-stage and three-stage processes, of the Carnot cycle.

19 Claims, 5 Drawing Figures

VARIANT INCLUDED IN THE EXAMPLE OF APPLICATION

PROPOSED BASIC PROCESS

PROCESS IN ONE STAGE

PROCESS IN THREE STAGES

THERMODYNAMIC PROCESS FOR A PRACTICAL APPROACH TO THE CARNOT CYCLE

BACKGROUND OF THE INVENTION

This invention relates to a thermodynamic process, and more particularly to a process for a practical approach to the ideal transformations in a theoretical cycle of thermal to mechanical energy transformation, with an efficiency close to that of the ideal Carnot cycle.

The above-mentioned theoretical cycle, which the invention approaches, includes a process fluid that undergoes two isothermal transformations absorbing and yielding heat energy at the thermal levels of a heat source and a heat sink, respectively, and two constant pressure heat exchange steps with an identical average heat capacity in which the process fluid exchanges heat with itself in two separate stages (heating and cooling, respectively) and with the additional condition that the thermal levels of the source and the sink are sufficiently separated for the absolute value of the heat energy transformed into mechanical energy in the process to be sufficiently high.

SUMMARY OF THE INVENTION

The process conditions indicated above require a set of very specific properties of the fluid to be used in the process, among which the following may be noted:

a. Very close saturation pressures at extreme process temperatures (corresponding to the energy source and sink) so that the isothermal energy absorption and yield transformations may be made at the thermal levels of the energy source and sink and a constant pressure, which is the only practical form of carrying out the isothermal transformations. In addition, at close thermal levels and at the two close pressures indicated, the properties of the fluid are very similar, thus obtaining average curve slopes (average heat capacity) for the two heat exchange isobars which practically coincide at intermediate thermal levels. This condition will allow heat to be exchanged within the process fluid itself at the various thermal levels with minimum heat decay, and therefore with minimal losses from irreversibility due only to the minimum gradient necessary to maintain the heat flow.

b. Minimum difference between the temperature at which the process fluid enters the transforming element (such as a turbine or the like) and the outlet temperature after adiabatic expansion between the established pressure values (negligible isentropic expansion), so that the maximum amount of heat energy may be recovered at intermediate thermal levels in constant pressure transformations, as indicated above. This condition requires a process fluid with a high molecular mass to be used, in addition to the condition relating to minimum pressure difference in the expansion.

c. High mean specific heat values, corresponding to constant pressure transformations at the two pressures indicated, within the range of temperatures between that corresponding to the sink and that registered at the outlet to the turbine. In accordance with the previous condition, the temperatures must be very close to the source temperature. This condition is required so that the minimum gradient necessary for a desired heat flow to exist is the minimum possible, with the thermal levels in the heat exchange operation approaching each other, thereby maintaining heat exchange losses due to irreversibility to the absolute minimum, as indicated.

d. The process fluid must be thermally stable within the temperature range in which the process is carried out.

e. The freezing point of the process fluid must be lower than the thermal level of the heat sink.

DESCRIPTION OF THE PREFERRED EMBODIMENTS

Figure 2:
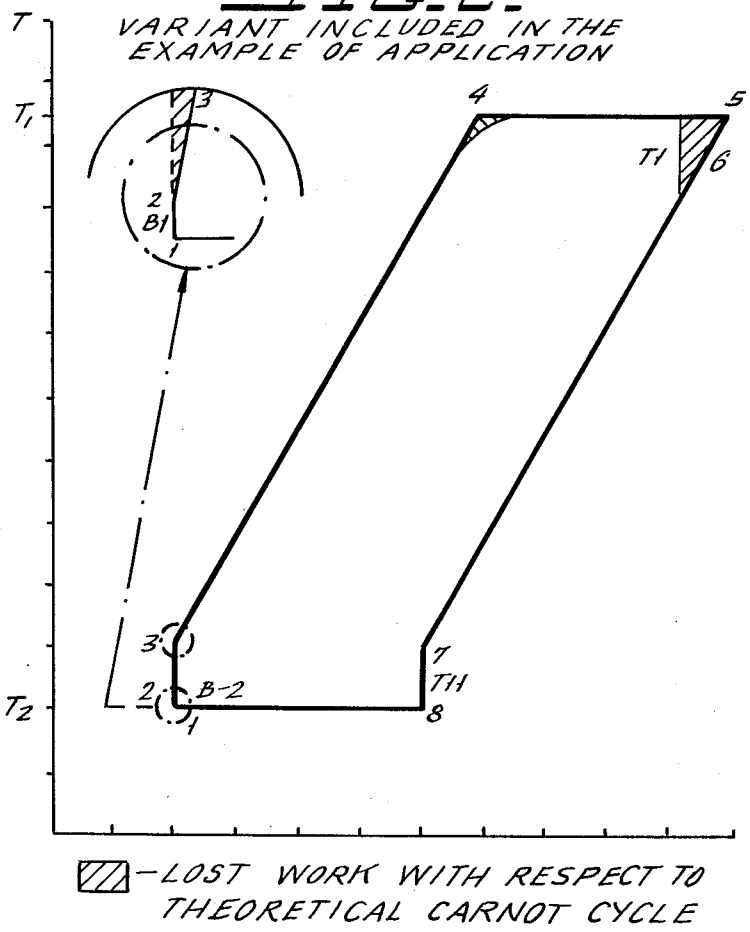
FIG. 2 is a temperature-entropy diagram for a practical Carnot cycle in accordance with the present invention.
Figure 1:
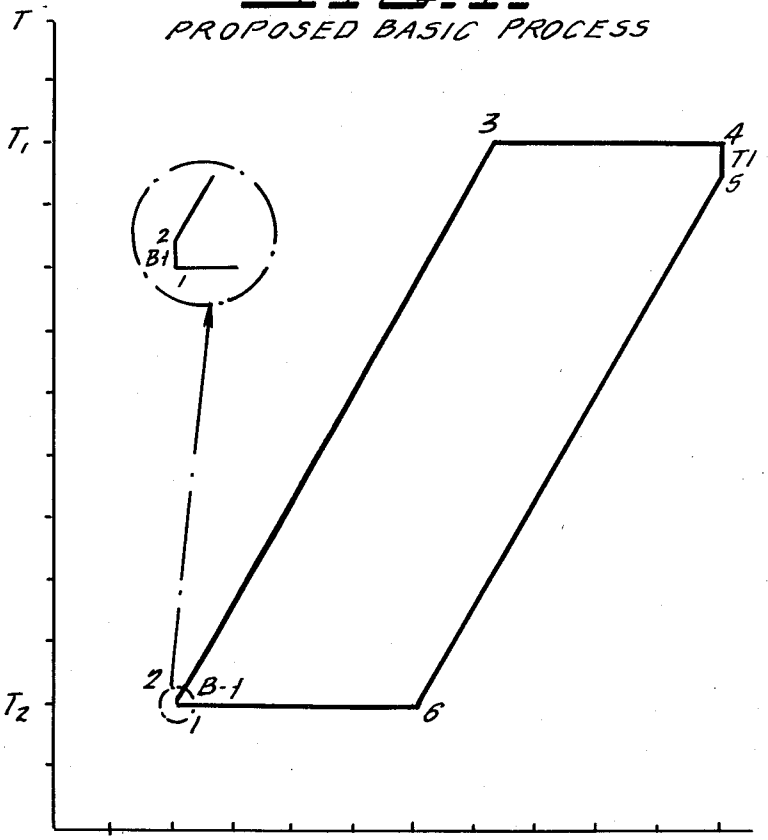
FIG. 1 is a temperature-entropy diagram for an ideal Carnot cycle.

Referring now to the drawings, and particularly to FIGS. 1 and 2 thereof, FIG. 1 shows a temperature-entropy diagram for an ideal reversible cycle in accordance with the present invention. The cycle includes a reversible process in which the temperature changes from $T_2$ at point 1 on the graph to $T_1$ at point 3 on the graph, a reversible isothermal process at $T_1$ from points 3 to 4, a reversible process in which the temperature changes from $T_1$ to $T_2$, and which proceeds from point 4 to point 6 on the graph, and a reversible isothermal process from points 6 to point 1 on the diagram. FIG. 2 shows the same basic cycle as FIG. 1 but includes a variant as repesented by the process flow diagram illustrated in FIG. 3, and in which the cross hatched areas shown represent the work that is lost relative to a theoretical cycle.

Figure 3:
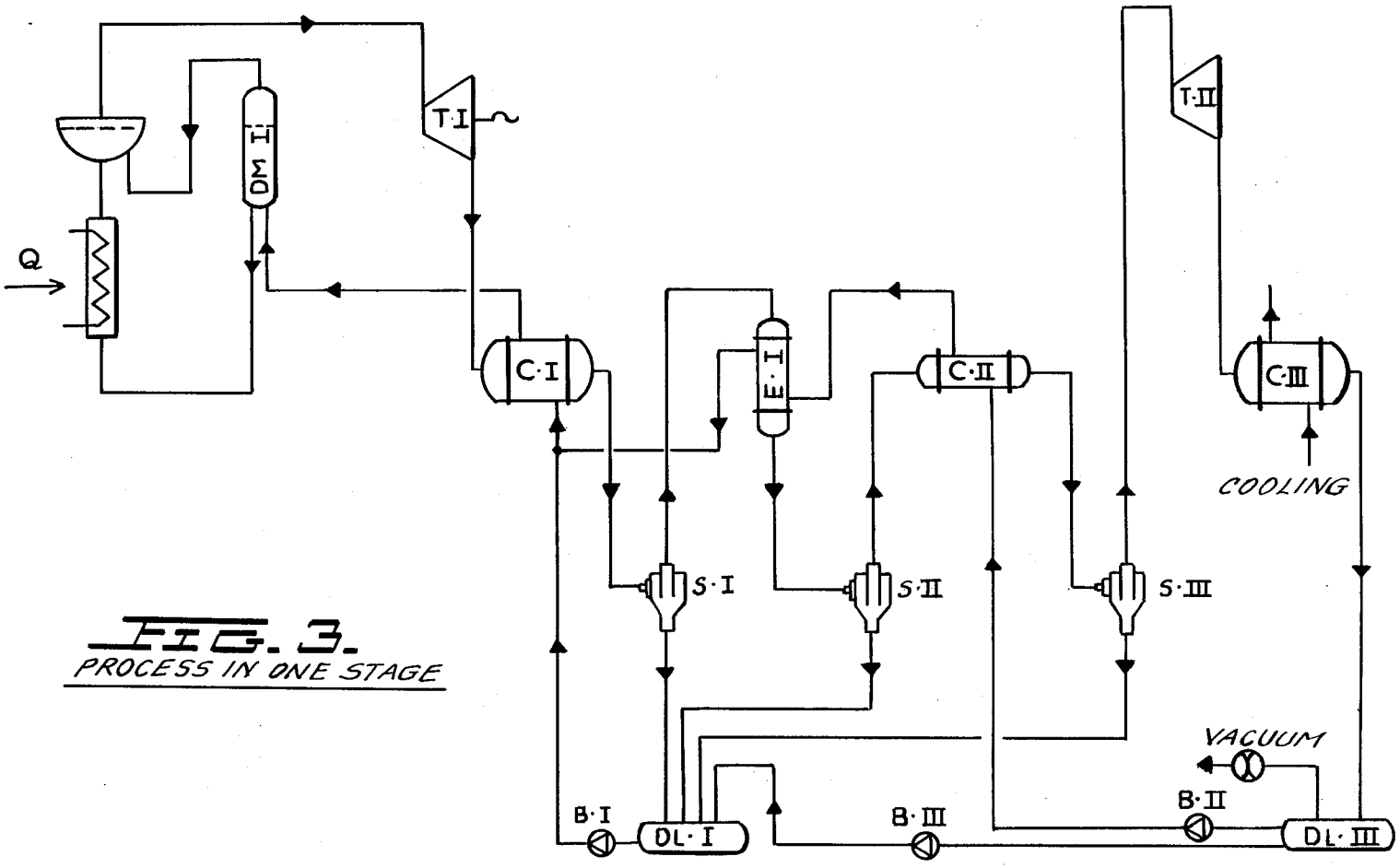
FIG. 3 is a flow diagram showing the equipment arrangement for the process of the present invention performed in one stage.
Figure 4A:
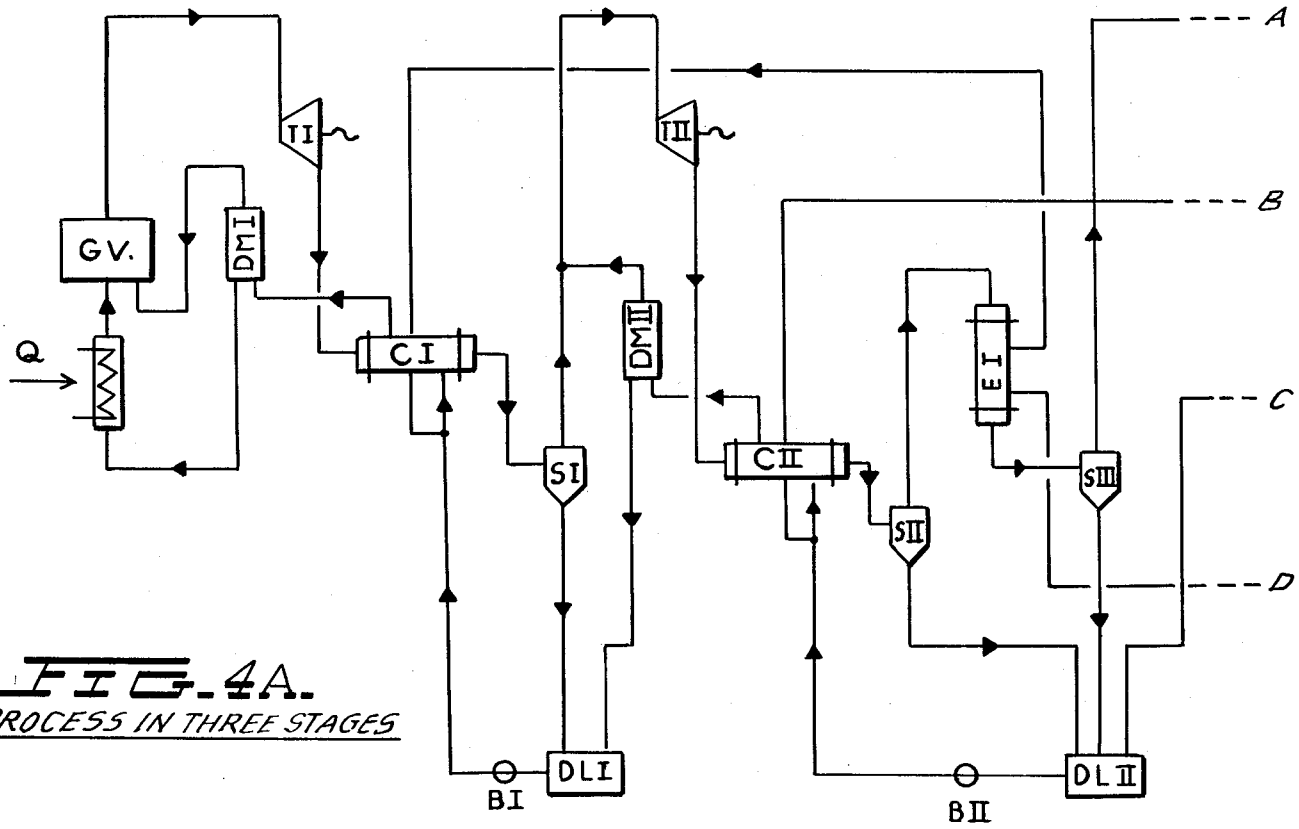
FIGS. 4A and 4B together constitute a flow diagram similar to FIG. 3 showing the equipment arrangement for the process of the present invention performed in three stages. Any reference herein to FIG. 4 should be deemed to refer to both FIG. 4A and FIG. 4B.
Figure 4B:
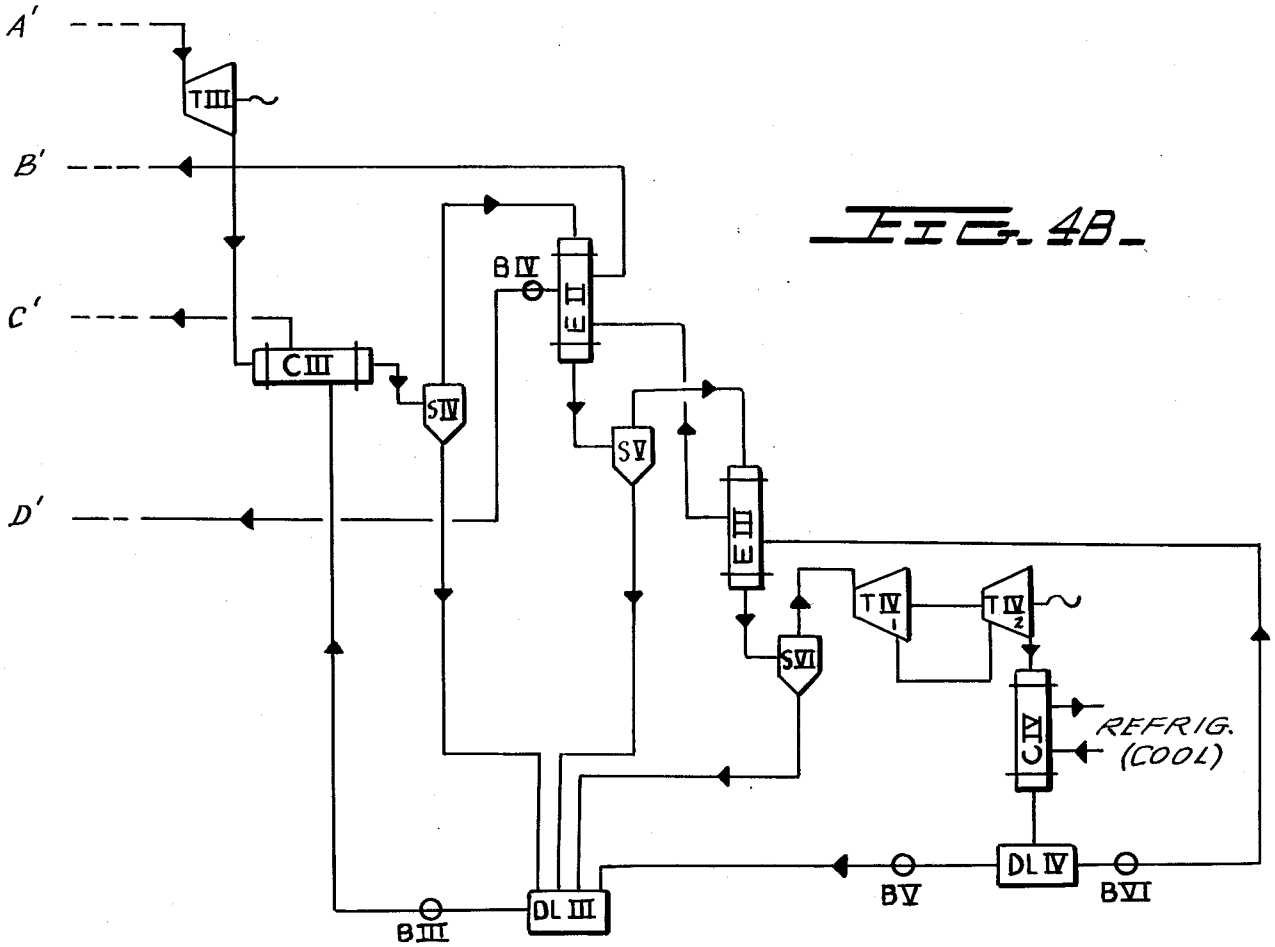

The flow diagram for actual cycles in accordance with the present invention are illustrated in FIGS. 3, 4A and 4B of the drawings. In FIG. 3, a one stage work output process is shown in terms of a flow diagram showing the several elements and their interconnections. A saturated vapor from a vapor generator is conveyed to turbine T-1, through which expansion occurs and as a result of which work output is available. The fluid then flows from turbine T-1 to the tube side of condenser C-1, which is a shell and tube heat exchanger. The fluid is cooled and is conveyed to a phase separator S-1, from which the liquid phase flows to a liquid collection tank DL-1, and the vapor phase is conveyed to the tube side of a shell and tube heat exchanger E-I. The fluid is passed through successive heat exchangers E-I and C-II, with phase separators S-II and S-III on the respective inlet and outlet sides of heat exchanger C-II. Again, the liquid phases of the materials that pass through phase separators S-II and S-III are conveyed to liquid collection tank DL-I. The vapor phase from the phase separator S-III is conveyed to a second turbine T-II, from which it flows to the tube side of a condenser in the form of a shell and tube heat exchanger C-III. The condensed vapor from C-III is conveyed to liquid collection tank DL-III, which is under vacuum, and a portion of the liquid is conveyed by means of pump B-II to the shell side of heat exchanger C-II, from which it is conveyed to the shell side of heat exchanger E-I, and then to the shell side of heat exchanger C-I. Another portion of the liquid from liquid collection tank DL-III is conveyed by means of pump B-III to liquid collection tank DL-I, and the entire contents of that liquid collection tank is also transferred to the shell side of heat exchanger C-I, by means of pump B-I, from which it flows to a phase separator DM-I and then to the vapor generator.

Referring now to FIGS. 4A and 4B, there is shown a three stage process, in which work output is provided by means of three turbines TI, TII, and TIII. That process includes a number of additional heat exchangers C-I, C-II, C-III, and C-IV. The process also includes heat exchanger E-I, which is a high pressure water vapor boiler, and heat exchanger E-II, which is a low pressure water boiler. Phase separators S-I through S-VI are provided on the respective tube outlet sides of the heat exchangers in order to separate the vapor from the liquid phases of the process fluid. Liquid collection tanks DL-I through DL-IV are included in the flow circuit to provide points for collection of the liquid that is separated from the process fluid. Additionally pumps B-I through B-VI are provided to convey the liquid to the shell inlet sides of the various heat exchangers provided. Additionally, phase separators DM-I and DM-II are provided at the outlets of the shell sides of each of heat exchangers C-I and C-II, respectively. The three stage process also includes a two stage turbine $T\text{-}IV_1$ and $T\text{-}IV_2$ from which the process fluid exits to enter into heat exchanger C-IV, which is the final condenser in the system. The interconnections and interrelationships between the various elements will be hereinafter be described in more detail in connection with specific examples of the process wherein Example I represents the single stage process illustrated in FIG. 3, and Example II represents the three stage process illustrated in FIGS. 4A and 4B.

The conditions hereinabove mentioned are fulfilled by the use as the process fluid of a group of substances with different vapor pressures at a given temperature, so that the saturation pressure of the least volatile component at the thermal level of the heat source is greater than, but as close as possibile to, the saturation pressure of the most volatile component at the thermal level of the heat sink.

In order to economize on component equipment, a further condition may be added, requiring that the pressures also approach atmospheric pressure, i.e., that the boiling point of the least volatile component substance should be close to the thermal level of the heat source and that of the most volatile component should be close to the thermal level of the heat sink.

The group of substances to be used as the process fluid may be miscible or immiscible in the liquid state. The basic process for this group of substances is described below, including basic installation components.

a. At the highest process pressure, the fluid with the highest boiling point coexists in its liquid state in equilibrium with its vapor state and the reheated vapors of the other components, under the inlet conditions to the vapor generator, where it is vaporized and the heat energy of the source absorbed at constant pressure with a very small average transformation slope, which is, therefore, very close to the isotherm.

All the components absorb heat in the vapor generator from the heat source and from the inlet temperature to the highest process temperature, but, in accordance with the conditions imposed, these will be very close to each other and the requirements of the previous paragraph will be met.

Under these conditions, the fluid with the highest boiling point will leave the vapor generator in the form of a saturated vapor within the gaseous mixture formed by the rest of the components, at the highest process pressure and temperature.

b. In the turbine, expansion is performed from the pressure conditions at the outlet of the vapor generator down to the lowest process pressure, in accordance with the conditions imposed thereon, so that the outlet temperature will be very close to the inlet temperature.

c. At the turbine outlet conditions, the vapor enters a constant pressure heat exchanger, where it yield energy, cools and condenses progressively down from the substance with the highest boiling point so that, at each temperature there is a saturated vapor-liquid mixture of these components, until a temperature is reached which is close to that of the heat sink, under which conditions the vapor state will be comprised, in the main, of the component with the lowest boiling point (the most volatile), at which stage the mixture will be discharged from the heat exchanger.

In practice, it is advisable to divide this transformation, so that the condensed liquid phases may be separated at each stage, avoiding on the one hand the need for further cooling the liquid only to heat it again on the other side of the heat exchanger and, on the other hand, thus obtaining in general a greater equality of the mean heat capacity. In this way, the relative compositions of the various components are also variable in this heat-yielding transformation.

The energy that is yielded under these conditions is absorbed at a constant pressure—greater, but only slightly different—by the process fluid so that, at lower thermal levels, the most volatile fluid is saturated and totally vaporized; this vapor serves to support the continuous vaporization of the remaining group components, as the temperature rises due to the heat absorbed up to the saturation molar composition for each temperature. This continues until complete vaporization is achieved of all components at the highest temperature in the heat exchanger, with the exception of the least volatile component which continues in the liquid state until it is vaporized at higher thermal levels (source).

Should these isobaric transformations be divided into various stages, the liquid phases drained (at each resultant step) in the energy-yielding area at the lower pressure, are pumped to the higher pressure, thus joining the following heating stage in the heat absorption area.

In this way, maximum equalization of mean heat capacities (curve slopes) is achieved for the constant pressure energy absorption and yield transformation indicated.

In addition, the slopes for these transformations are very small since vaporization and condensation are continuous, thus reducing the mean thermal gradients which are necessary for a suitable speed of heat flow.

The division into various expansion stages is necessary when a higher value of transformation efficiency is required, with a process fluid in which there is too great a difference between the saturation pressure of the least volatile fluid at the thermal level of the source and that of the most volatile fluid at the thermal level of the sink.

The expansion may be applied in all cases where, firstly, the most volatile component has a low molecular mass and a saturation pressure at the thermal level of the sink somewhat lower than that of the least volatile at the thermal level of the source (as is the case in the examples, which clarify but do not limit the possibilities for applying the process herein described; secondly, where the resultant vapor—after separation and drainage of the liquid phases—in the initial stage of this new expansion is practically composed of the most volatile component; and thirdly, where the mean specific heat of the constant pressure heating of this condensed liquid is negligible with regard to the mean specific heats of the other transformations in the process.

The process fluid enters on the other side of the constant pressure heat exchanger, the process fluid having been totally condensed (in step (d), below) and compressed to the highest process pressure, and the component with the lowest boiling point will be totally vaporized under the highest process pressure conditions, at its corresponding saturation temperature, and this vapor will serve as a support in the continuous vaporization of the other components, as the temperature rises due to the heat absorbed, reaching the saturation molar composition for each temperature until all components are totally vaporized at the highest temperature at the outlet to the heat exchanger (the inlet to the vapor generator), except for the component with the highest boiling point, which will coexist in the liquid stage and will be totally vaporized in the vapor generator at the highest process temperature, as indicated above.

If the difference between the pressures on both sides of the heat exchanger is small, in accordance with the requirements of the prior condition, the molar compositions of the vapor phases at each temperature are quite similar, so that the average specific heat of the constant pressure heat absorption and yield transformations throughout the range of temperatures is very similar. Logically, there are real irreversibilities, due fundamentally to the need to maintain a thermal gradient for heat transfer in an acceptable heat flow, but in this case it is minimal due to the slight slope of the constant pressure curves on both sides of the heat exchanger (very high mean specific heat) due to the existence of continuous condensation and vaporization, respectively, as indicated above.

d. Total condensation of the component with the lowest boiling point (the most volatile) from the conditions at the outlet of the constant pressure heat exchanger, at the lowest process pressure and the thermal level of the sink.

In the conditions indicated, if the molar composition of the vapor at the heat exchanger outlet is practically that of the most volatile component, and the outlet temperature, due to the minimum gradient necessary, is close to that of the heat sink (saturation temperature of the vapor phase of the most volatile component at the lowest process pressure), this constant pressure transformation will also be practically isothermal, thus producing the total condensation of the process fluid, and yielding residual process heat to the sink, or the cold point.

In practice, it is advisable to divide the constant pressure heat exchanger described herein into several heat exchangers, in order to separate the condensed liquid phase at the outlet to each, thus reducing the need for heat exchange surfaces and obtaining greater equality between the average heat capacities in the heat exchange.

Nevertheless, the need to discover real fluids which fulfill all the conditions imposed is limited, so that it is necessary to compromise by accepting an approximate fulfillment of the conditions, which may involve greater complexity of the process described when, for given thermal levels for the source and sink, quite different high and low pressures are occasioned in the process. In this case, the process must be carried out in various stages or expansions in the turbines to provide high transformation efficiency, and, in accordance with the philosophy described, in such a way that in each case the number of stages is defined "a priori" for each application in accordance with the efficiency factors to be obtained, on the one hand, and practical economic feasibility on the other.

Two examples of practical applications are given below, one single stage process and one three stage process, and the differences, for this specific case, in the efficiency obtained in the transformations in both cases can be appreciated.

In these examples of practical applications, the following have been chosen as the process fluid:

A eutectic mixture of 26.5% diphenyl and 73.5% diphenyl oxide, a product marketed by the Dow Chemical Company under the trademark DOWTHERM-A, and which will be referred to hereinafter as D-A, as the least volatile fluid.

Distilled water, as the most volatile fluid.

The criteria followed in the selection of these fluids for the examples of practical applications were fundamentally their low cost and ease of procurement, and the fact that both fluids have been widely tested in heat transfer applications.

Nevertheless, D-A has a significant disadvantage in its heat stability level which, although relatively high (over 400° C., according to the manufacturer) and although it is easily regenerated, limits the highest process thermal level. Thus, the absolute efficiency of the transformation (if heat energy sources with higher thermal levels than those indicated are available). Obviously, this disadvantage does not exist if fluids with greater thermal stability are used.

With regard to the water, as the most volatile process fluid, it apparently does not comply with the requirements imposed but, nevertheless, as it is a compound with a low molecular mass, and thus a very high latent heat for the change of state, in conditions removed from the critical temperature, relative to the mean specific heat of the liquid phase in the working area, it gives rise to the fact that the isobar slope in the heating of the liquid phase is very elevated. Therefore, in this area, the isobar is, in practice, very close to the isentropic within the context of process development, since the other isobar curves have much smaller slopes and the example described may be considered a permissible variant to the basic process indicated, in which part of the constant pressure heat exchange in the last stage has been substituted by isentropic expansion in the turbine and constant pressure heating of the liquid water.

If another fluid with different characteristics from those of water were used, the solution would occasion significant losses in process transformation efficiency.

FIG. 1 shows the theoretical (reversible) process described, while FIG. 2 corresponds to the variant indicated in the example shown in the single-stage version. The theoretical isobars in the diagram correspond to the mean specific heats of the transformations. FIG. 1 is a temperature-entropy diagram for the ideal process, and FIG. 2 is the corresponding temperature-entropy diagram for the process in accordance with the present invention. As shown in FIG. 2, there are several points in the actual process in which losses occur, and those losses are represented by the cross-hatched areas shown in FIG. 2.

In accordance with the previous indications, two examples of practical applications follow, for single- and triple-stage processes, respectively, and using the process fluid described. The physical arrangement of the various elements of such a process are illustrated schematically in FIG. 3, which represents a single-stage process. Similarly, FIGS. 4A and 4B represents the arrangement of the various elements for a three-stage process. In each process, however, the preferred process working fluid has the characteristics described hereinabove, which have been found to provide a desirably high efficiency level when employed in the disclosed process. In connection with the single- and three-stage processes disclosed, the number of stages represent the number of stages of heat recovery, and in FIG. 3, relating to the single-stage process, the heat recovery is provided by heat exchanger E-I, whereas in the FIGS. 4A and 4B process, representing a three-stage process, the three stages of heat recovery are represented by heat exchangers E-I, E-II, and E-III. In Example I that follows, the various process conditions are defined for the inlets and outlets of the respective elements shown in FIG. 3. Similarly, in Example II hereinbelow, the various process conditions at the inlets and outlets of the several elements illustrated in FIGS. 4A and 4B are provided. In each instance the process conditions are illustrated to demonstrate the practical application of the process to provide improved results in terms of greater efficiency relative to the efficiency of the theoretical process cycle.

In these examples, an overall heat and circulating mass balance is made, using the same units of measurement for both heat and transformed mechanical energy.

The basic purposes of these examples is not to obtain the maximum heat to mechanical energy transformation with the process described, but to demonstrate that, between two predetermined thermal levels, which are sufficiently separated to make the absolute value of energy transformed attractive (668° k. and 298° k. in the example), the practical application of the process permits an approximation to the theoretical efficiency of the Carnot cycle to be obtained between those thermal levels, with an efficiency much greater than that of any other real thermodynamic process in existence.

In addition, and in accordance with the indications herein, the possibility of increasing the absolute value of the efficiency depends only on the greater heat stability of the fluids selected for the process.

For the process thermal and mass balance, the following simplified nomenclature and units of measurement are used:

P—Absolute pressure, in Bars (bar)

T—Temperature, in degrees kelvin (°k.)

H—Total heat flow per unit time, i.e., the product of the total enthalpy at a specific point by the total circulating mass, in kilojoules/second (kJ/s)

h—Total enthalpy, in kilojoules/kilogram (kJ/kg)

D-A—Dowtherm-A fluid, described elsewhere herein $a_L$—Mass flow of liquid water, in kilograms/second (kg/s)

$a_V$—Mass flow of water vapor, in kilograms/second (Kg/s)

$A_L$—Mass flow of liquid D-A, in kilogram/second (kg/s)

$A_V$—Mass flow of D-A vapor, in kilograms/second (kJ/s)

Q—Heat flow in the heat exchangers, in kilojoules/-second (kJ/s)

W—Mechanical energy per time unit, in kilojoules/-second (kilowatts) (kW)

EXAMPLE I

PROCESS IN ONE STAGE

Vapor Generator
Pressure P = 17.65 bar

| Inlet | Outlet |
|---|---|
| P = 17.65 bar | P = 17.65 bar |
| $a_v$ = 33 kg/s | $a_v$ = 33 kg/s |
| $A_v$ = 47.39 kg/s | $A_V$ = 310 kg/s |
| $A_L$ = 260.61 kg/s | T = 663.5° K. |
| T = 574° K. | H = 372,884 kJ/s |
| H = 242,439.6 kJ/s | |

ENERGY RELEASED BY THE SOURCE: 130,444.4 kJ/s
Vapor is saturated D-A vapor under these conditions Turbine T-1

| Inlet | Outlet |
|---|---|
| P = 17.65 bar | P = 1.96 bar |
| $a_v$ = 33 kg/s | $a_v$ = 33 kg/s |
| $A_V$ = 310 kg/s | $A_V$ = 310 kg/s |
| T = 663.5° K. | T = 603.16° K. |
| H = 372,884 kJ/s | H = 333,636.2 kJ/s |
| | (Tsat = 530.05° K.) |
| | (Hsat = 278,948.2 kJ/s |

TRANSFORMED ENERGY: $W_1 = \Delta H$ = 39,247.78 kJ/s

HEAT EXCHANGER C-1

(A) Shell: Pressure P = 17.65 bar
(a) Inlet

| Fluid I | Fluid II | Resulting Fluid |
|---|---|---|
| $A_L$ = 310 kg/s | $a_v$ = 33 kg/s | $a_v$ = 33 kg/s |
| T = 483° K. | T = 477.2° K. | $A_V$ = 5.07 kg/s |
| H = 77,108.7 kJ/s | H = 84,298.54 kJ/s | $A_L$ = 304.93 kg/s |
| | | T = 480.3° K. |
| | | H = 161,407.25 kJ/s |

(b) Outlet

| | |
|---|---|
| $a_v$ = 33 kg/s | T = 574° K. |
| $A_V$ = 47.39 kg/s | H = 242,439.6 kJ/s |
| $A_L$ = 260.61 kg/s | |

HEAT ABSORBED: Q = Δ H = 81,032.33 kJ/s (B) TUBES: Pressure: P = 1.96 bar

| (a) Inlet | Outlet |
|---|---|
| $a_v$ = 33 kg/s | $a_v$ = 33 kg/s |
| $A_V$ = 310 kg/s | $A_V$ = 211.26 kg/s |
| T = 603.16° K. | $A_l$ = 98.74 kg/s |
| H = 333,636.21 kJ/s | T = 520.7° K. |
| | H = 252,603.87 kJ/s |
| Outlet vapor phase | Outlet liquid phase |
| $a_v$ = 33 kg/s | $A_L$ = 98.74 kg/s |
| $A_V$ = 211.26 kg/s | T = 520.7° K. |
| T = 520.7° K. | H = 32,459.38 kJ/s |
| H = 220,144.49 kJ/s | (Drained to DL-I) |

HEAT EXCHANGER E-I (A) SHELL: Pressure P = 17.65 bar

| (a) Inlet | Outlet |
|---|---|
| $a_L$ = 33 kg/s | $a_v$ = 33 kg/s |
| T = 477.2° K. | T = 477.2° K. |
| H = 17,146.2 kJ/s | H = 84,298.54 kJ/s |

HEAT ABSORBED: Q = Δ H = 67,152.34 kJ/s (B) TUBES Pressure P = 1.96 bar

| (a) Inlet | Outlet |
|---|---|
| $a_v$ = 33 kg/s | $a_v$ = 33 kg/s |
| $A_V$ = 211.26 kg/s | $A_V$ = 53.21 kg/s |
| T = 520.7° K. | $A_L$ = 158.05 kg/s |
| H = 220,144.49 kJ/s | T = 481° K. |
| | H = 152,992.16 kJ/s |
| Outlet vapor phase | Outlet liquid phase |
| $a_v$ = 33 kg/s | $A_L$ = 158.05 kg/s |
| $A_V$ = 53.21 kg/s | T = 481° K. |
| T = 481° K. | H = 38,555.19 kJ/s |

-continued

H = 114,436.96 kJ/s (Drained to DL-I)

HEAT EXCHANGER C-II (A) SHELL Pressure P = 17.65 bar

| (a) Inlet | (b) Outlet |
|---|---|
| $a_L$ = 33 kg/s | $a_L$ = 33 kg/s |
| T = 298° K. | T = 477.2° K. |

ΔT = 452.2° K.

ABSORBED HEAT: Q =

452.2° K. × 4.187 kJ/Kg °K. × 33 Kg/s = 24,759.06 kJ/s (B) TUBES Pressure P = 1.96 bar

| (a) Inlet | (b) Outlet |
|---|---|
| $a_v$ = 33 kg/s | $a_v$ = 33 kg/s |
| $A_V$ = 53.21 kg/s | $A_V$ = 6.61 kg/s |
| T =481° K. | $A_L$ = 46.6 kg/s |
| H = 114,436.96 kJ/s | T = 421.4° K. |
| | H = 89,677.91 kJ/s |
| Outlet vapor phase | Outlet liquid phase |
| $a_v$ = 33 kg/s | $A_L$ = 46,6 kg/s |
| $A_V$ = 6.61 kg/s | T = 421.4° K. |
| T = 421.4° K. | H = 5,841.4 kJ/s |
| H = 83,836.48 kJ/s | (Drained to DL-I) |

TURBINE T-II

| Inlet | Outlet |
|---|---|
| P = 1.96 bar | P = 0.03167 bar |
| $a_v$ = 33 kg/s | $a_v$ = 29.6 kg/s |
| T = 421° K. | $A_L$ = 3.4 kg/s |
| h = 2,769.36 kJ/kg | T = 298° K. |
| S = 7,2848 kJ/kg °K. | h = 2,167.34 kJ/kg |
| | S = 7.2848 kJ/kg °K. |

Ah = 602.02 kJ/kg

TRANSFORMED ENERGY:

W = $\dot{m}$ × Δ h = 19,866.66 kJ/s

HEAT EXCHANGER C-III (FINAL CONDENSER)

All the vapor at this stage (which is composed mainly of steam) that comes out of the turbine T-II is condensed in the condenser conveying this heat to the energy sink, in this case to the temperature of 298° K.

Energy released to the sink: Q=71,329.97 kJ/s

CONCLUSIONS (a) Heat absorbed from the SOURCE:

$Q_1$=130,444.4 kJ/s (b) Total energy transformed:

$W_T$=59,114.43 kJ/s (c) Transformation efficiency:

$\eta = Wt/Q1$=0.453 (45.3%)

EXAMPLE II

PRACTICAL EXAMPLE OF APPLICATION.-PROCESS IN THREE STAGES

PROCESS AND THERMAL BALANCE PARAMETERS

Vapor Generator

| Inlet | Outlet |
|---|---|
| P = 14.706 bar | P = 14.706 bar |
| T = 606.5° K. | T = 668° K. |
| $a_v$ = 25 kg/s | $a_v$ = 25 kg/s |
| $A_v$ = 88.52 kg/s | $A_v$ = 407.08 kg/s |
| $A_L$ = 318.56 kg/s | H = 440,065.54 kJ/s |
| H = 306,496.66 kJ/s | |

ENERGY RELEASED BY THE SOURCE: 183,568.88 kJ/s

As indicated previously, the resulting vapor at the outlet of this equipment is saturated D-A vapor under these conditions.

Turbine T-I

-continued

PRACTICAL EXAMPLE OF APPLICATION.-PROCESS IN THREE STAGES

PROCESS AND THERMAL BALANCE PARAMETERS

| Inlet | Outlet |
|---|---|
| P = 14.706 bar | P = 14.706 bar |
| T = 668° K. | T = 633.65° K. |
| $a_v$ = 25 kg/s | $a_v$ = 25 kg/s |
| $A_V$ = 407.08 kg/s | $A_V$ = 407.08 kg/s |
| H = 440,065.54 kJ/s | H = 411,196.13 kJ/s |
| | ($T_{sat}$ = 577.24° K. |
| | ($H_{sat}$ = 365,781.41 kJ/s |

TRANSFORMED ENERGY: W = Δ H = 28,869.41 kJ/s

Exchanger C-I (A) Shell: Pressure P = 14.706 bar (a) Inlet

| Fluid 1 | Fluid 2 |
|---|---|
| $A_L$ = 407.08 kg/s | $a_v$ = 25 kg/s |
| T = 536° K. | T = 468.83° K. |
| H = 147,496.73 kJ/s | H = 63,459.32 kJ/s |

Resulting Fluid $a_v$ = 25 kg/s $A_V$ = 15.79 kg/s $A_L$ = 391.29 kg/s

T = 527.6° K.

H = 210,956.06 kJ/s (b) Outlet

| | |
|---|---|
| $a_v$ = 25 kg/s | T = 606.5° K. |
| $A_V$ = 88.52 kg/s | H = 306,496.66 kJ/s |
| $A_L$ = 318.56 kg/s | |

HEAT ABSORBED: Q = H = 95,540.6 kJ/s (B) Tubes: Pressure P = 3.922 bar (a) Inlet (Turbine T-I exhaust fluid)

$a_v$ = 25 kg/s $A_V$ = 407.08 kg/s

T = 633.65° K.

H = 411,196.13 kJ/s (b) Outlet $a_v$ = 25 kg/s $A_V$ = 257.52 kg/s $A_L$ = 149.56 kg/s

T = 566.62° K.

H = 315,655.53 kJ/s

Liquid DL-I Collection Tank

Pressure P = 3.922 bar (a) Inlet

Exchanger C-I pipe outlet drainage $A_L$ = 149.56 kg/s H = 64,485.81 kJ/s

T = 566.62° K.

Exchanger C-II shell outlet liquid phase $A_L$ = 257.52 kg/s H = 83,010.93 kJ/s

T = 517.7° K.

(b) Outlet

Pump B-1 suction fluid $A_L$ = 407.08 kg/s H = 147,496.73 kJ/s

T = 536° K.

Phase DM-II Separator

Pressure P = 3.922 bar (a) Inlet

Exchanger C-I pipe outlet vapor phase $a_v$ = 25 kg/s H = 251,179.61 kJ/s $A_V$ = 257.52 kg/s

T = 566.62° K.

Exchanger C-II shell outlet vapor phase $a_v$ = 5 kg/s $A_V$ = 10.93 Kg/s H = 19,991.43 kJ/s (saturated)

T = 517.7° K.

(b) Inlet and drainage at tank DL-I

Exchanger C-II shell outlet liquid phase $A_L$ = 257.52 kg/s H = 83,010.93 kJ/s

T = 517.7° K.

(c) Outlet

Resulting vapor phase, turbine T-II drive $a_v$ = 30 kg/s T = 564° K.

$A_V$ = 368.45 kg/s H = 271,171.03 kJ/s

Turbine T-II

Inlet Outlet

-continued

PRACTICAL EXAMPLE OF APPLICATION.-PROCESS IN THREE STAGES
PROCESS AND THERMAL BALANCE PARAMETERS

| | |
|---|---|
| P = 3.922 bar | P = 0,98 bar |
| $a_v$ = 30 kg/s | $a_v$ = 30 kg/s |
| $A_V$ = 268.45 kg/s | $A_V$ = 268.45 kg/s |
| T = 564° K. | T = 527.6° K. |
| H = −271,171.03 kJ/s | H = 251,867.88 kJ/s |
| | ($T_{sat}$ = 499.67° K. |
| | ($H_{sat}$ = 237,420.15 kJ/s |

TRANSFORMED ENERGY: W = Δ H = 19,303.16 kJ/s

Exchanger C-II (A) Shell: Pressure P = 3.922 bar (a) Inlet

| Fluid 1 | Fluid 2 |
|---|---|
| $A_L$ = 268.45 Kg/s | $a_v$ = 5 Kg/s |
| T = 467° K. | T = 416.5° K. |
| H = 57,940.33 kJ/s | H = 12,187.99 kJ/s |

Resulting Fluid $a_v$ = 5 kg/s
$A_V$ = 2.27 kg/s
$A_L$ = 266.18 kg/s
T = 464.8° K.
H = 70,128.31 kJ/s (b) Outlet

| | |
|---|---|
| $a_v$ = 5 kg/s | T = 517.7° K. |
| $A_V$ = 10.93 kg/s | H = 103,002.35 kJ/s |
| $A_L$ = 357.52 kg/s | |

ABSORBED HEAT: Q = Δ H = 32,874.04 kJ/s (B) Tubes: Pressure P = 0.98 bar (a) Inlet (Turbine T-II exhaust fluid)

| | |
|---|---|
| $a_v$ = 30 kg/s | T = 527.6° K. |
| $A_V$ = 268.45 kg/s | H = 251,867.46 kJ/s |

(b) Outlet

| | |
|---|---|
| $a_v$ = 30 Kg/s | T = 495.2° K. |
| $A_V$ = 216.72 kg/s | H = 218,993.83 kJ/s |
| $A_L$ = 51.73 kg/s | |
| Outlet vapor phase | outlet liquid phase |
| $a_v$ = 30 kg/s | $A_L$ = 51.73 kg/s |
| $A_V$ = 216.72 kg/s | T = 495.2° K. |
| T = 495.2° K. | H = 14,196.66 kJ/s |
| H = 204,798.07 kJ/s | (Drained to DL-II) |

Exchanger E-I (High pressure water vapor boiler (A) Shell: Pressure P = 14.706 bar (a) Inlet $a_L$ = 25 kg/s
T = 416.5° K.
H = 6,646.55 kJ/s (b) Outlet $a_v$ = 25 kg/s (saturated vapor)
T = 468.83° K.
H = 63,459.33 kJ/s ABSORBED HEAT: Q = Δ H = 56,812.78 KJ/s (B) Tubes: Pressure P = 0.98 bar (a) Inlet (C-II pipe outlet vapor phase)

| | |
|---|---|
| $a_v$ = 30 kg/s | T = 495.2° K. |
| $A_V$ = 216.72 kg/s | H = 204,798.07 kJ/s |

(b) Outlet

| | |
|---|---|
| $a_v$ = 30 kg/s | T = 469.03° K. |
| $A_V$ = 74.75 kg/s | H = 147,985.29 kJ/s |
| $A_L$ = 141.97 kg/s | |
| Outlet vapor phase | Outlet liquid phase |
| $a_v$ = 30 kg/s | $A_L$ = 141.97 kg/s |
| $A_V$ = 74.75 Kg/s | T = 469.03° K. |
| T = 469.03° K. | H = 31,223.98 kJ/s |
| H = 116,761.31 kJ/s | (Drained to DL-II) |

Liquid DL-II Collection Tank

Pressure: P = 0.98 bar (a) Inlet

Exchanger C-II pipe outlet liquid phase

| | |
|---|---|
| $A_L$ = 51.73 kg/s | H = 14,196.27 kJ/s |
| T = 495.2° K. | |

Exchanger E-I pipe outlet liquid phase

| | |
|---|---|
| $A_L$ = 141.97 kg/s | H = 31,223.98 kJ/s |
| T = 469.03° K. | |

Exchanger C-III shell outlet liquid phase

| | |
|---|---|
| $A_L$ = 74.75 kg/s | H = 12,520.08 kJ/s |
| T = 442.9° K. | |

-continued

PRACTICAL EXAMPLE OF APPLICATION.-PROCESS IN THREE STAGES
PROCESS AND THERMAL BALANCE PARAMETERS (b) Outlet Pump B-II suction

| | |
|---|---|
| $A_L$ = 268.45 kg/s | H = 57,940.33 kJ/s |
| T = 467° K. | |

Turbine T-III

| Inlet | (E-I pipe outlet vapor phase) | Outlet |
|---|---|---|
| P = 0.98 bar | | P = 0.49 bar |
| $a_v$ = 30 kg/s | | $a_v$ = 30 kg/s |
| $A_V$ = 74.75 kg/s | | $A_V$ = 71.87 kg/s |
| T = 469.03° K. | | $A_L$ = 2.88 kg/s |
| H = 116,761.31 kJ/s | | T = 446.1° K. |
| | | H = 111,700.68 kJ/s |

TRANSFORMED ENERGY: W = Δ H = 5,060.63 kJ/s

Exchanger C-III (A) Shell: Pressure P = 0.98 bar (a) Inlet $A_L$ = 74.75 kg/s
T = 403° K.
H = 6,775.67 kJ/s (b) Outlet $A_L$ = 74.75 kg/s
T = 442.9° K.
H = 12,520.08 kJ/s ABSORBED HEAT: Q = Δ H = 5,744.42 kJ/s (B) Tubes: Pressure P = 0.49 bar (a) Inlet (Turbine T-III discharge fluid)

| | |
|---|---|
| $a_v$ = 30 kg/s | T = 446.1° K. |
| $A_V$ = 71.87 kg/s | H = 111.700.68 kJ/s |
| $A_L$ = 2.88 kg/s | |

(b) Outlet

| | |
|---|---|
| $a_v$ = 30 kg/s | T = 440.8° K. |
| $A_V$ = 57.56 kg/s | H = 105,956.26 kJ/s |
| $A_L$ = 17.19 kg/s | |
| Outlet vapor phase | Outlet liquid phase |
| $a_v$ = 30 kg/s | $A_L$ = 17.19 kg/s |
| $A_V$ = 57.56 kg/s | T = 440.8° K. |
| T = 440.8° K. | H = 2,794.19 kJ/s |
| H = 103,162.08 kJ/s | (Drained to DL-III) |

Exchanger E-II (Low pressure water boiler)

(A) Shell: Pressure P = 3.922 bar (a) Inlet $a_L$ = 5 kg/s (Saturated liquid)
T = 416.5° K.
H = 1,318.86 kJ/s (b) Outlet $a_v$ = 5 kg/s (saturated vapor)
T = 416.5° K.
H = 12,190.5 kJ/s ABSORBED HEAT: Q = Δ H = 10,869.14 kJ/s (B) Tubes: Pressure P = 0.49 bar (a) Inlet (C-III pipe outlet vapor phase)

| | |
|---|---|
| $a_v$ = 30 kg/s | T = 440.8° K. |
| $A_V$ = 57.56 kg/s | H = 103,162.08 kJ/s |

(b) Outlet

| | |
|---|---|
| $a_v$ = 30 kg/s | T = 426.5° K. |
| $A_V$ = 31.81 kg/s | H = 92,292.94 KJ/s |
| $A_L$ = 25.75 kg/s | |
| Outlet vapor phase | Outlet liquid phase |
| $a_v$ = 30 kg/s | $A_L$ = 25.75 kg/s |
| $A_V$ = 31.81 kg/s | T = 426.5° K. |

-continued

| PRACTICAL EXAMPLE OF APPLICATION.-PROCESS IN THREE STAGES PROCESS AND THERMAL BALANCE PARAMETERS | |
|---|---|
| T = 426 5° K. | H = 3,488.2 kJ/s |
| H = 88.804 75 kJ/s | (Drained to DL-III) |

Exchanger E-III (Water heater that could be incorporated into E-II)

(A) Shell: Pressure P = 3.922 bar

| (a) Inlet | (b) Outlet |
|---|---|
| $a_L$ = 30 kg/s | $a_L$ = 30 kg/s |
| T = 298° K. | T = 416.5° K. |
| | Δ t = 416.5–298° |
| | k = 118.5° K. |

ABSORBED HEAT: Q = 30 kg/s × 4.187 kJ/kg °k × 391.5° k. = 14,884.07 kJ/s (B) Tubes: Pressure P = 0.49 bar (a) Inlet $a_v$ = 30 kg/s
$A_V$ = 31.81 kg/s
T = 426.5° K.
H = 88,804.75 kJ/s (b) Outlet $a_v$ = 30 kg/s
$A_V$ = 3.92 Kg/s
$A_L$ = 27.89 kg/s
T = 379.27° K.
H = 73,920.68 kJ/s

| Outlet vapor phase | Outlet liquid phase |
|---|---|
| $a_v$ = 30 kg/s | $A_L$ = 27.89 kg/s |
| $A_V$ = 3.92 kg/s | T = 379.87° K. |
| T = 379.87° K. | H = 1,331.78 kJ/s |
| H = 72,588.9 kJ/s | (Drained to DL-III) |

Turbine T-IV

The exchanger E-III pipe outlet vapor phase enters into this turbine, resulting in a pressure change in several stages (to avoid supercritical nozzle speeds) from $P_1$=0.49 bar to $P_2$=0.03166 bar, which is the saturation pressure of the water vapor at the process inferior thermal level of 25° C.

In view of the fact that water in the liquid phase at 353° K. has been used as the enthalpy origin in the calculation program for this equipment, the program has been dispensed with and the parameters included in the saturated and reheated water vapor tables have been used.

Under these conditions, the obtained values are as follows:

(a) Inlet

| | |
|---|---|
| $a_v$ = 30 kg/s | T = 379.87° K. |
| $A_V$ = 3.92 kg/s | H = 72,589.06 kJ/s |

Pressure P=0.49 bar

Water vapor enthalpy under these conditions:

$h_1$=2,696.26 kJ/kg

Water vapor entropy under these conditions:

$S_1$=7.715 kJ/kg.°K.

(b) Outlet

Pressure: P=0.03166 bar temperature:=298° K.

Final entropy after the adiabatic jump:

$S_2$=7.715 kJ/kg°K.

Corresponding enthalpy:

$h_2$=2,285.41 kJ/kg (c) Energy transformed into mechanical work:

$\Delta h = h_1 - h_2$=410.85 kJ/kg

Thus:

W=30 kg/s×410.85 kJ/kg=12,325.52 kJ/s

The influence on this point of the 3.92 kg/s of fluid D-A, as additional work, is inappreciable.

Taking liquid water at 298° K. as the enthalpy origin, the total heat content of the outlet fluid is as follows:

$H$=67,171.51 kJ/s=60,263.29+6,908.22

30 kg/s×4.1868 *kJ/kg°C.*×328° K.=6,908.22 kJ/s

Exchanger C-IV (final condenser

All the vapor phase resulting from the turbine T-IV discharge is condensed in this exchanger, and this heat is released to the sink or cold point of the process at a temperature of 298° K. The most common cooling fluid will be water, which will circulate through the exchanger shell.

The released energy under these conditions is as follows:

Q=67,171.51 kJ/s

The condensed liquid, $a_L$=30 kg/s and $A_L$=3.92 kg/s, is drained to tank DL-IV, where the separation due to the difference in density of both liquids occurs. Subsequently, liquid D-A is drained from from this tank to DL-III.

The vacuum equipment required to create and maintain the process conditions will be installed in tank DL-IV.

CONCLUSIONS

The fluids selected from the basic process mixture fluid in the example were selected in accordance with the criteria indicated in the beginning, and logically they are not the optimum fluids insofar as obtaining a good transformation efficiency under the conditions set forth is concerned.

The process calculated as an example has in no way been optimized. For example, the values of the pressure changes in the turbines have been selected in a very arbitrary way, and the minimum exact gradients in the latter exchangers are excessive, thus allowing exchanger E-II, for example, to vaporize approximately 1 kg/s of additional water under these conditions.

Regardless of the above, the process yields the following thermal balances:

Heat absorbed from the source:

$q_1$=133,568.88 kJ/s

Energy transformed in the turbine:

$W_T = W_I + W_{II} + W_{III} + W_{IV}$=65,558.71 kJ/s

Energy released to the cold point:

$q_2$=67,170.67 kJ/s

Total error committed in the balance:

$$\epsilon = 838.66 \text{ kJ/s}$$

(0,63% with respect to the source)
(1.25% with respect to the transformed energy)
Transformation efficiency:

$$\eta = \frac{W_T}{q_1} = \frac{65{,}558.71}{133{,}568.88} = 0.49082 \ (49.08\%)$$

efficiency of the theoretical Carnot cycle between the same thermal levels.

$$\eta_c = \frac{T_1 - T_2}{T_1} = \frac{637.25 - 298}{637.25} = 0.532 \ (53.2\%)$$

Retalive efficiency of the process with regard to the theoretical Carnot cycle:

$$\lambda = \frac{\eta}{\eta_c} = 0.9225 \ (92.25\%)$$

It must be emphasized that the absolute efficiency can be increased by using a thermally stable fluid at higher temperatures, or else with the same fluids indicated in the example once the process is optimized, and using a first stage of higher thermal levels (for example, a Brayton or Rankine cycle).

The additional losses, which are not taken into consideration in the process balance set forth above, are indicated below. Although minimized calculation parameters have been used (total heats and no enthalpies, without considering the pressure, etc.) these additional losses could be considered with a view to obtaining a real minimized efficiency.

Mechanical efficiency of the pumps

Load loss of the fluid in its passage through pipes and exchangers.

isentropic efficiency of the turbines.

With regard to the first point, and taking into account a pump efficiency of 50%, the losses evaluated as not recoverable in heat energy in the process, are as follows:

$$\text{Total losses} = 553.49 \text{ kJ/s } (0.4\%)$$

The joint losses in the other two points, evaluated for the process conditions, do not reach 1.5%, and thus the real losses will establish the efficiency as follows:

$$\eta_{real} > 47\%$$

In accordance with all the above, this thermodynamic process permits a practical approach to the Carnot cycle. This is a completely new process offering many advantages because of the possibility of making the efficiency of transformation of heat energy between two defined and sufficiently separated thermal levels (a heat source and a heat sink) approach the transformation efficiency of a thermodynamic cycle comprised of two isotherms (absorption and yield) and two isobars, which coincide in providing the same efficiency as the Carnot cycle. To date, there has been no practical process which, operating between the said thermal levels, achieves a heat to mechanical energy transformation efficiency comparable to that obtained by the process which is the subject of this invention.

Furthermore, the equipment and components used in this process are completely conventional, with characteristics and performance which are well known, and involve no greater investment in their procurement than that made for other recognized processes with the same power; quite the contrary in the majority of applications. The effect of lower costs is favorably increased if the saturation pressures defined are very close to atmospheric pressure.

A sufficiently thorough description of the nature of this invention having been provided, it must be expressly emphasized that any modification of details which might be introduced will be considered as included within the process as long as its characteristics are not altered.

What is claimed is:

1. A process for mechanical power generation comprising:

(a) selecting a working fluid mixture comprising a plurality of fluids having different boiling points wherein
  (1) at a maximum working temperature and pressure, the mixture of vapors of such fluids is saturated with respect to the component having the highest boiling point, and
  (2) the fluid having the lowest boiling point saturates at a minimum working temperature, for a minimum working pressure;

(b) performing one expansion in an expansion device of the mixture of fluid vapors initially saturated with respect to the component having the highest boiling point, from the maximum working pressure to the minimum working pressure;

(c) performing a stage of heat recovery, with heat exchange between (1) the mixture of fluids exhausted by said expansion device, which yields heat and undergoes condensation of at least some of its components, and (2) a fluid mixture coming from a final condenser and compressed to the maximum working pressure, which absorbs heat and undergoes vaporization of at least some of its components;

(d) performing total condensation in said condenser of the mixture that comes out of the hot side of the heat recovery stage, at the minimum working temperature; and (e) contributing heat to the fluid mixture, once the latter has come out of the cold side of the heat recovery stage, until all the remaining liquid fraction in the fluid mixture that corresponds to the component having the highest boiling point is vaporized.

2. A process in accordance with claim 1 in which the working fluid includes a first component having a low volatility and a high boiling point approximately corresponding with the temperature of a heat source for providing heat to the process, and having a saturation pressure corresponding approximately with atmospheric pressure at a maximum process temperature, and a second component having a high volatility and a saturation pressure corresponding approximately with atmosheric pressure at a minimum process temperature.

3. A process in accordance with claim 1 in which the working fluid includes a plurality of fluids having different vapor pressures at a given temperature wherein a working fluid component having the lowest volatility at the thermal level of a heat source has a first saturation pressure, and a second component having the highest volatility has a second saturation pressure at the thermal level of a heat sink, said first saturation pressure being substantially the same as said second saturation pressure.

4. A process in accordance with claim 3 wherein said first saturation pressure is greater than said second saturation pressure.

5. A process in accordance with claim 4 wherein said saturation pressures are substantially atmospheric pressure.

6. A process in accordance with claim 5 wherein said first component is a eutectic mixture of 26.5% diphenyl and 73.5% diphenyl oxide and said second component is water.

7. A process as in claim 1, wherein step (b) includes performing a plurality of expansions in turbines, said mixture of fluid vapors passing through a series of intermediate pressures between each successive pair of such turbines; and step (c) includes performing a stage of heat recovery from the mixture of fluids exhausted by each such turbine, the pressure in the cold side of each stage of heat recovery being immediately superior to that of the mixture in the hot side of that stage.

8. A process as in claim 7, including selecting a working fluid composition having adequate mass ratios; and such that the component thereof with the lowest boiling point will totally vaporize in the heat recovery stages, absorbing the condensation and cooling energy of the components with higher boiling point which circulates through the hot side of the heat recovery stages, the vapor produced thereby serving as support for the continuous vaporization of the remaining components until these latter components reach their molar composition of saturation for each temperature and until the total vaporization of all the components at the maximum outlet temperature of the recovery stages, except for the component having the highest boiling point, which will be in two phases and will be totally vaporized in an external energy receiver, thereby reaching the maximum working temperature; and through the hot side of the heat exchangers will circulate the discharge vapors of the turbines, which will yield this energy while condensing progressively the components of higher boiling point in such a way that, for each temperature, the composition of the saturated component in the mixture will be that corresponding to said temperature and partial pressure of saturation.

9. A process as in claim 8, including selecting a working fluid having miscible components such that the vaporization of the component with the lowest boiling point is neither alone nor isothermal, to drag part of the vapors of other components.

10. A process as in claim 7, further comprising installing a phase separator, at the cold-side outlet of each heat recovery stage, prior to the stage of the highest thermal level, for conducting the vapor phase to the turbine that precedes each recovery stage, and conducting the liquid phase, after being compressed, to a point of similar temperature of the heat absorption part, either separated or mixed with liquid phases of other separators.

11. A process in accordance with claim 7, further comprising installing a phase separator at the cold-side outlet of the recovery stage with the highest thermal level, for conducting the liquid phase to an external energy receiver and the vapor phase to a flash tank where it is mixed with the vapors generated by flashing of the heated liquid phase.

12. A process as in claim 7, including carrying out the heat exchanges at each pressure level in a selected number of heat exchangers in series, depending on variable characteristics of the mixture during the heat exchange.

13. A process as in claim 7, further comprising installing a phase separator at the hot-side outlet of at least one of the heat exchangers, for conducting the vapor phase to the hot side of the next device with lower operating temperature, said next device being one of a heat exchanger, a turbine, or the condenser; and conducting the liquid phase, after being compressed, to a point of similar temperature to that of the heat absorption part, either separated or mixed with liquid phases of other separators.

14. A process as in claim 7, wherein heat is not exchanged after the last turbine, the mixture exhausted by the last turbine passing directly to the condenser, with or without previous separation of phases.

15. A process as in claim 7, wherein any immiscible components in liquid phase are separated during the heat absorption process, so as to simplify any heat exchanger, and are mixed together subsequently with the flow which has passed through the heat exchanger.

16. A process as in claim 7, wherein for heat recovery from a variable energy source, the residual energy below the maximum working temperature is also absorbed by the fluid mixture for heating and vaporization of the various components, so as to complement the heat absorption proceeding from the mixture exhausted by the turbine, or replacing it completely, either because of working with a fluid mixture with humid expansion, or because of recovering the energy for heating processes or in another secondary cycle.

17. A process comprising a primary cycle as in claim 7, and further comprising a secondary cycle in which a single fluid, with lower boiling point than any of the fluids of the primary cycle, operates according to an independent Rankine cycle, said secondary cycle and the above-mentioned primary cycle together constituting a binary cycle, the primary cycle having a condensation temperature that permits heating and vaporizing the fluid of the lowest boiling point.

18. A process as in claim 17 in which the secondary cycle not only absorbs at least part of the heat available in the mixture exhausted by the turbines, but also absorbs at least one of: (a) at least part of the energy available in a heat source having a variable thermal level, and (b) at least part of the energy available from other heat sources.

19. A process as in claim 17 in which, instead of using a Rankine cycle with one sole component in the low temperature range, said independent Rankine cycle is used at intermediate temperatures, with a fluid of intermediate boiling point that can absorb the heat yielded by the fluid mixture in the cooling phase of the primary cycle, as well as from the heat source.

* * * * *

UNITED STATES PATENT AND TRADEMARK OFFICE

CERTIFICATE OF CORRECTION

PATENT NO. : 4,691,523

DATED : September 8, 1987

INVENTOR(S) : Serafin Mendoza Rosado

It is certified that error appears in the above-identified patent and that said Letters Patent is hereby corrected as shown below:

On the Title Page, Item [76] Inventor:

Please change the name of the inventor from "Serafin M. Rosado" to --Serafin Mendoza Rosado--.

Signed and Sealed this

Eighth Day of March, 1988

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,691,523

DATED : September 8, 1987

INVENTOR(S) : Serafin Mendoza Rosado

It is certified that error appears in the above-identified patent and that said Letters Patent is hereby corrected as shown below:

FIG. 1.
PROPOSED BASIC PROCESS

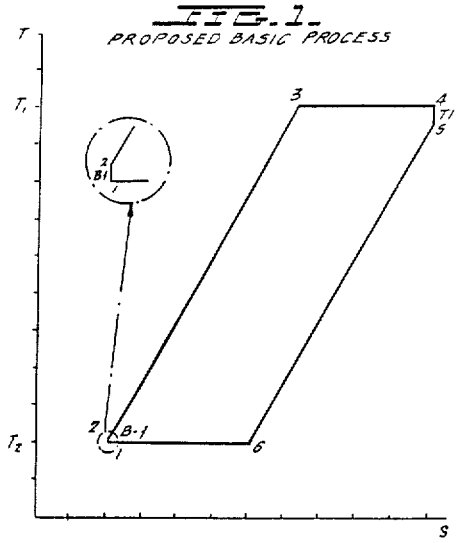

UNITED STATES PATENT AND TRADEMARK OFFICE

CERTIFICATE OF CORRECTION

PATENT NO. : 4,691,523

DATED : September 8, 1987

INVENTOR(S) : Serafin Mendoza Rosado

It is certified that error appears in the above-identified patent and that said Letters Patent is hereby corrected as shown below:

FIG. 2.

VARIANT INCLUDED IN THE EXAMPLE OF APPLICATION

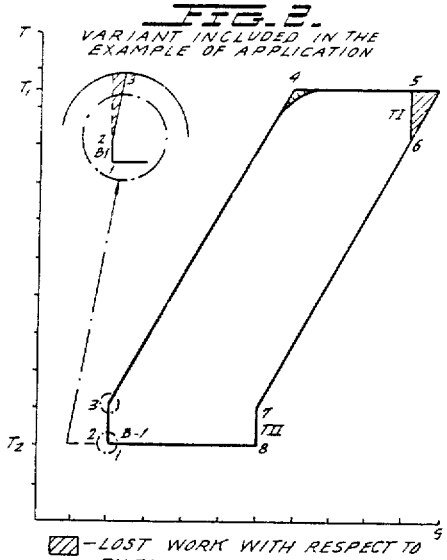

▨ – LOST WORK WITH RESPECT TO THEORETICAL CARNOT CYCLE

UNITED STATES PATENT AND TRADEMARK OFFICE

CERTIFICATE OF CORRECTION

PATENT NO. : 4,691,523 Page 4 of 6

DATED : September 8, 1987

INVENTOR(S) : Serafin Mendoza Rosado

It is certified that error appears in the above-identified patent and that said Letters Patent is hereby corrected as shown below:

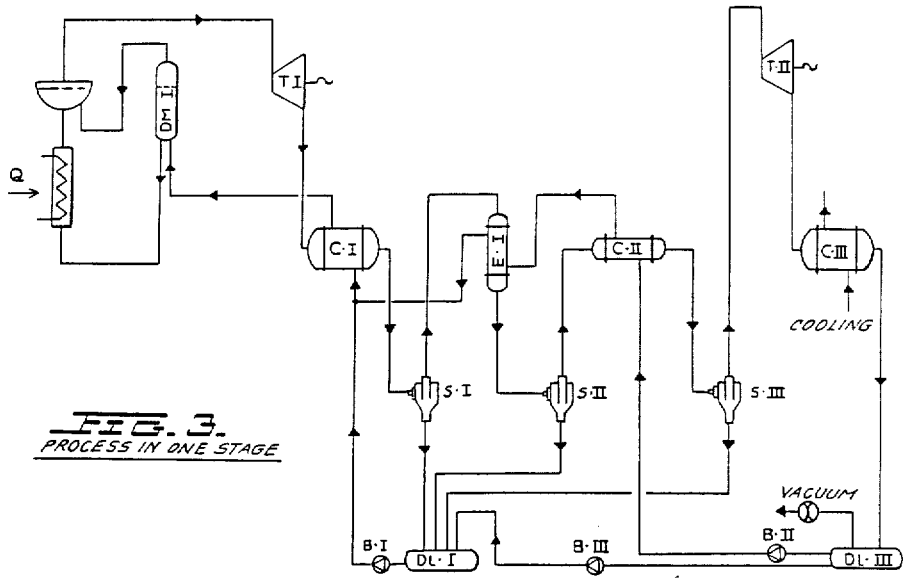

FIG. 3.
PROCESS IN ONE STAGE

UNITED STATES PATENT AND TRADEMARK OFFICE

CERTIFICATE OF CORRECTION

PATENT NO. : 4,691,523 Page 5 of 6

DATED : September 8, 1987

INVENTOR(S) : Serafin Mendoza Rosado

It is certified that error appears in the above-identified patent and that said Letters Patent is hereby corrected as shown below:

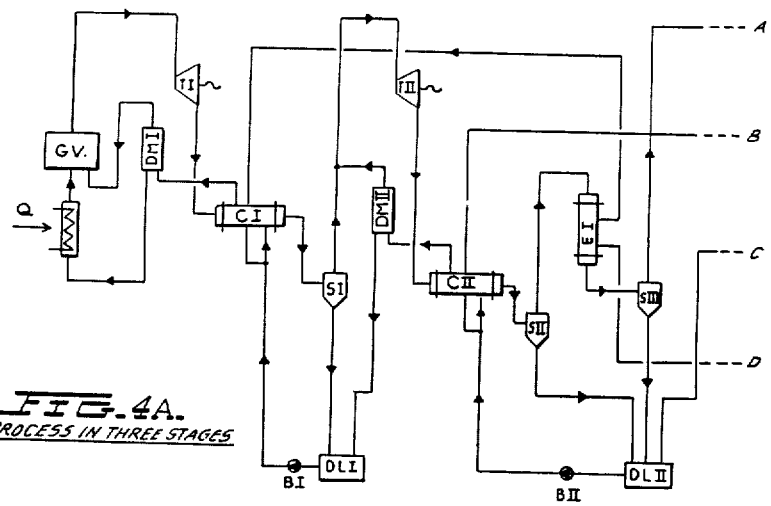

FIG. 4A.
PROCESS IN THREE STAGES

UNITED STATES PATENT AND TRADEMARK OFFICE

CERTIFICATE OF CORRECTION

PATENT NO. : 4,691,523 Page 6 of 6

DATED : September 8, 1987

INVENTOR(S) : Serafin Mendoza Rosado

It is certified that error appears in the above-identified patent and that said Letters Patent is hereby corrected as shown below:

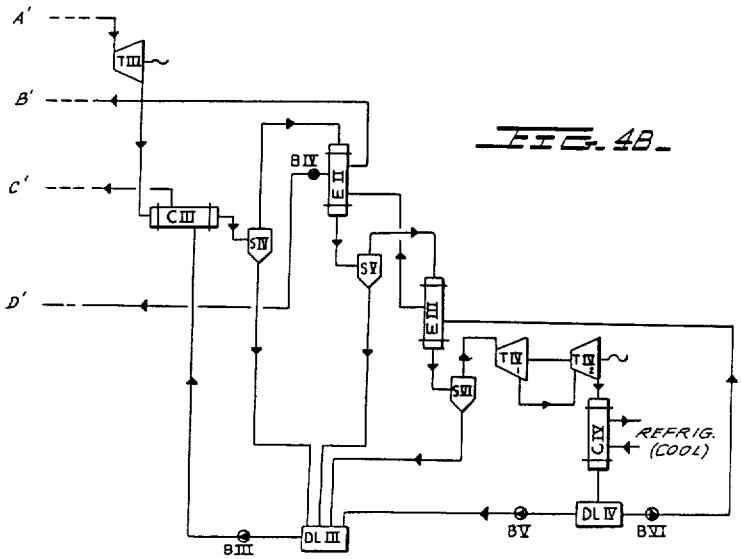

FIG. 4B